US011703051B2

(12) United States Patent
Terzo et al.

(10) Patent No.: US 11,703,051 B2
(45) Date of Patent: Jul. 18, 2023

(54) VALVELESS HYDRAULIC SYSTEM

(71) Applicant: Terzo Power Systems, LLC, El Dorado Hills, CA (US)

(72) Inventors: Michael B. Terzo, Single Springs, CA (US); Manuel Arciga, Sacramento, CA (US); Anthony C. Gomez, Folsom, CA (US); Andrew J. A. Spencer, Davis, CA (US)

(73) Assignee: TERZO POWER SYSTEMS, LLC, El Dorado Hills, CA (US)

( * ) Notice: Subject to any disclaimer, the term of this patent is extended or adjusted under 35 U.S.C. 154(b) by 328 days.

(21) Appl. No.: 16/787,638

(22) Filed: Feb. 11, 2020

(65) Prior Publication Data

US 2020/0256336 A1 Aug. 13, 2020

Related U.S. Application Data

(60) Provisional application No. 62/804,709, filed on Feb. 12, 2019.

(51) Int. Cl.

| | |
|---|---|
| ***F04C 14/24*** | (2006.01) |
| ***F04C 14/28*** | (2006.01) |
| ***F04C 15/00*** | (2006.01) |

(52) U.S. Cl.

CPC ..... *F04C 14/24* (2013.01); *F04C 14/28* (2013.01); *F04C 15/0096* (2013.01);
(Continued)

(58) Field of Classification Search

CPC ..... F04C 14/24; F04C 14/28; F04C 15/0096; F04C 2240/30; F04C 2240/60;
(Continued)

(56) References Cited

U.S. PATENT DOCUMENTS 2,751,144 A * 6/1956 Troendle ..... F04B 25/02 92/144
4,306,841 A * 12/1981 Morrison ..... D06F 39/085 68/184

(Continued)

FOREIGN PATENT DOCUMENTS

CN 201874040 U 6/2011
CN 104246227 B 12/2016

(Continued)

OTHER PUBLICATIONS

Invitation to Pay Additional Fees and, Where Applicable, Protest Fee and Annex to Form PCT/ISA/206 Communication Relating to the Results of the Partial International Search dated Apr. 20, 2020, from International Patent Application No. PCT/US2020/017688, 15 sheets.

*Primary Examiner* — Philip E Stimpert
(74) *Attorney, Agent, or Firm* — Katten Muchin Rosenman LLP

(57) ABSTRACT

Disclosed herein is an integrated pump system in which a motor is directly coupled to a pump, preferably using a modular connection. The integrated pump system may operate in a uni-directional or bi-directional mode. The integrated pump system incorporates an internal cooling channel which directs the returning low pressure hydraulic fluid past the controller and the motor for cooling purposes. The low pressure hydraulic fluid is also directly fed into the coupling between the motor and the pump to provide both cooling and lubrication.

17 Claims, 9 Drawing Sheets

(52) U.S. Cl.
CPC ..... *F04C 2240/30* (2013.01); *F04C 2240/60* (2013.01); *F04C 2240/808* (2013.01)

(58) Field of Classification Search
CPC ..... F04C 2240/808; F04C 2240/81; F04C 14/00; F04C 2270/16; F04C 2270/165; F04B 53/08; F04B 39/06; F04D 29/5813
USPC ..... 417/360
See application file for complete search history.

(56) References Cited

U.S. PATENT DOCUMENTS

| | | | | |
|---|---|---|---|---|
| 4,918,585 | A * | 4/1990 | Miller | F04B 49/00 210/97 |
| 5,181,837 | A | 1/1993 | Niemiec | |
| 5,778,671 | A * | 7/1998 | Bloomquist | F15B 21/087 60/464 |
| 6,116,040 | A * | 9/2000 | Stark | F04B 39/06 62/113 |
| 6,471,494 | B1 * | 10/2002 | Miura | F04C 23/008 417/354 |
| 9,174,508 | B2 | 11/2015 | Anderson et al. | |
| 2003/0206805 | A1 | 11/2003 | Bishop et al. | |
| 2010/0021313 | A1 | 1/2010 | Devan et al. | |
| 2011/0060508 | A1 * | 3/2011 | Filla | F15B 13/14 701/50 |
| 2011/0084638 | A1 * | 4/2011 | Patel | F04C 18/00 318/473 |
| 2011/0223038 | A1 | 9/2011 | Ogawa et al. | |
| 2017/0002807 | A1 | 1/2017 | Kogiso | |
| 2017/0235318 | A1 * | 8/2017 | Bright | F04B 49/065 137/2 |
| 2019/0128267 | A1 | 5/2019 | Van Steenburg et al. | |

FOREIGN PATENT DOCUMENTS

| | | | | |
|---|---|---|---|---|
| CN | 105375830 | B | 12/2017 | |
| CN | 106088246 | B | 8/2018 | |
| CN | 208263967 | U | 12/2018 | |
| DE | 102015219095 | A1 * | 4/2017 | F04B 17/03 |
| EP | 0817356 | A1 | 1/1998 | |
| EP | 2353956 | A1 | 8/2011 | |
| JP | H10212916 | A | 8/1998 | |
| JP | 2000041750 | A | 2/2000 | |
| JP | 2002130216 | A | 5/2002 | |
| JP | 2013147825 | A | 8/2013 | |
| KR | 20180000934 | A | 1/2018 | |
| KR | 101926938 | B1 | 12/2018 | |

* cited by examiner

VALVELESS HYDRAULIC SYSTEM

CROSS-REFERENCE TO RELATED APPLICATIONS

This application claims priority to U.S. Provisional Application Ser. No. 62/804,709, filed Feb. 12, 2019, the entire contents of which are hereby incorporated by reference in their entirety.

FIELD

Descriptions herein are generally directed to a hydraulic system, and more particular descriptions are directed to a hydraulic system with an integrated motor and pump device.

BACKGROUND

A traditional hydraulic system has a motor to drive a pump, where the pump outputs fluid in response to being driven by the motor. Traditional hydraulic systems use motors that take a significant amount of time and energy to spin up from a stopped state, so motors are run continuously. Therefore, these traditional systems include valves to control the flow rate and pressure of the fluid out of the system. Traditional systems have separate motors and pumps, which requires interfaces that reduce the efficiency of the system. The systems with separate motors and pumps have more components, which tends to add to the system cost. The system setup and upkeep may also be higher in terms of labor with more independent parts that need separate maintenance and configuration to work together. Even with these inefficiencies, the least efficient part of the system is the valves, where a significant amount of energy loss occurs, considering the amount of work output from the valves relative to the energy input into the motor.

Additionally, with traditional systems, capabilities such as end of stroke detection, leak detection, or other capabilities required external sensors. Such sensors can add significant cost and size to the overall hydraulic system. The sensor inputs are fed back into the motor controller for control of the motor. It will be understood that the sensors provide useful information for the system but cannot overcome inherent inefficiencies of the traditional system design.

As described herein a hydraulic system has an integrated motor and pump. Integration of the motor and pump allows for elimination of certain interface components, which can increase the pump system efficiency. As described herein, the integrated pump system can eliminate the need for valves by directly driving the work function fluid from the integrated motor and pump. Elimination of the valves can remove the greatest inefficiency from the hydraulic system and enable more power delivery into the work function relative to energy inputted into the motor.

Direct driving of the fluid flow from the integrated motor and pump is possible with a motor that provides power on demand. A power-on-demand motor refers to a motor that can spin up and spin down on demand. The motor can operate on demand instead of needing to be constantly spinning as with traditional systems. Electronically controlled electric motors can allow for the operation needed by a motor to provide the direct hydraulic control.

In a traditional hydraulic system, the motor operates continuously to maintain fluid pressure, which is then regulated to the work function through high pressure output by the switching of valves. Such a system has been improved over the years by increasing the sensitivity and operation of the valves, as well as increasing the precision of the motor and the pump. However, with the system herein, such precision features added to traditional systems are unnecessary, while the system can still offer the same or improved precision operation.

SUMMARY

An integrated pump system as described herein can allow various implementations. In one example, an integrated pump system enables a valveless hydraulic system. In one example, an integrated pump system enables pressure detection and pressure control through directly driving the hydraulic fluid with the integrated pump system. In one example, an integrated pump system enables flow rate detection and control through directly driving the hydraulic fluid with the integrated pump system. In one example, an integrated system enables pumping post-work fluid as a coolant. The example provided in this paragraph can have multiple variations. The examples in this paragraph can be combined in any combination of features.

A hydraulic system provides fluid to a work function, which is typically one of two types. One type of work function is linear displacement. The linear displacement can be displacement of a rod, or displacement of an assembly with reference to a rod or other fixed reference mechanism. Another type of work function is rotary actuation. Rotary actuation refers to causing an assembly to rotate around an axis. The work function can be an axle itself, or an axle can be fixed as rotary actuation causes an assembly to rotate around the axle.

In one example, an integrated system includes a permanent magnet motor that provides power on demand. The motor can be driven by an inverter or other controller hardware. The controller hardware can include an encoder that controls the switching of power to the motor to cause the motor to spin. In one example, the controller will know the speed and torque of the motor. Thus, the integrated system can include information on speed and torque of the motor, which can directly inform the system on pump operation. The system can monitor and control the pressure of fluid output by the pump, which is changed directly by operation of the motor. The system can monitor and control the flow rate of the hydraulic fluid, which is changed directly by operation of the motor. The pressure or the flow rate, or both, can be considered the load on the integrated pump system. The controller can monitor load on the pump system and change operation of the motor based on reference setpoints or threshold of operation, as set by an administrator for the particular system implementation. It will be understood that different system implementations will have different requirements and different operating parameters.

In one example, the motor control can act as a proxy for fluid control. The control can be related to flow rate, or to pressure, or to both flow rate and pressure. The motor controller can calculate flow rate or pressure or both based on motor speed and torque of the motor. Such calculations may involve calibration by operating the integrated pump system and determining its operating parameters. An electronic circuit can store configuration information for a specific pump system, which enables the calculations to be specific to a device. In one example, a motor and controller that enables reversible motor operation can enable a bidirectional pump design. The use of a bidirectional pump can enable an implementation of a bidirectional, valveless pump system for implementations where bi-directionality is a factor.

The integration of the motor and pump together can reduce the cost, size, and weight of a hydraulic system. Additionally, the design can be made to include the motor controller directly integrated in the pump system, in one example. The integration of the pump system and power on demand enables the use of smaller motors relative to traditional designs. Additionally, rather than complicated and expensive designs for variable displacement pumps and high precision control valves, the system can use relatively simpler components and achieve precision through motor control based on feedback from measuring motor and pump performance and fluid flow. Use of the simpler components allows for more tolerance to impurities in the hydraulic fluid, which is projected to extend the operating time (time between maintenance) and the overall lifecycle (life of the pump system) as compared to traditional systems.

Integration of the pump system enables pumping the work fluid past the motor to cool the motor. Integration of the pump system can enable pumping the work fluid past the electronics to cool the motor controller circuitry. It will be understood that the hydraulic fluid heats up relative to the surrounding environment when put under pressure to convey to the work function. It is true that the post-work fluid returned through the low-pressure port of the pump system will be higher temperature than the surrounding environment, while cooling fluid traditionally starts out at the temperature of the environment. However, even heated for conveyance to the work function, the temperature of the post-work fluid is significantly cooler than the temperature of the motor components, or the temperature of the motor control electronics. Thus, the post-work fluid can still be effective at cooling the motor or the electronics, or both.

In one example, knowing the speed and operational parameters of the motor, directly controlling the high pressure output, the system can perform stall detection based on monitoring the operational states of the motor. For example, knowing a reference speed for a given pressure or flow rate, the system can detect deviation from the reference speed for an associated pressure or flow rate. In one example, if the motor has an expected pressure, $P_{EXP}$, for a reference motor speed, $VEL_{REF}$, the system can identify a stall if $P_{EXP}$ becomes some value greater than $1.0 \times P_{EXP}$ at constant $VEL_{REF}$. Similarly, in one example, if the motor has an expected pressure, $P_{EXP}$, for a reference motor speed, $VEL_{REF}$, the system can identify a leak if $P_{EXP}$ becomes less than $1.0 \times P_{EXP}$ at constant $VEL_{REF}$. Similar calculations can be performed for flow rate.

In one example, if the torque increases, the motor speed will slow down. For example, motor position detection can identify a slowdown in the motor speed and determine that a slow down or stall of the motor indicates an end of stroke detection for the work function. In response to such a condition, the controller can slow down or shut off the motor. Motor encoders typically have information on very fine resolution of the motor, for example, having a value greater than 1 to represent a single rotation of the motor. Thus, even slowdowns of the motor can be precisely detected or other changes of motor speed.

More specific descriptions for various implementations are provided below.

Valveless Hydraulic System

In one example, a system includes a power-on-demand pump system with an electronically controlled motor. The electronically controlled motor will selectively be on or off, or selectively be at very low RPM (rotations per minute) and high RPM. The motor can be made to spin fast for hydraulic pumping and then be turned off when the fluid flow is not needed, or a desired pressure applied by operation of the pump is no longer needed. In one example, the integrated system has a high-pressure fluid port to deliver hydraulic fluid from the pump system directly to the work function, without a fluid control valve. As stated above, the operation of the motor can directly drive the fluid with the pump, eliminating the need for a fluid control valve. The integrated motor and pump system includes a controller to selectively control the RPMs of the motor to directly control flow rate or pressure at the port, or to control both flow rate and pressure at the port.

In one example, the work function is linear displacement of a piston. Thus, the operation of the motor can spin up or spin down to cause the pump to increase or decrease flow rate or pressure or both, causing a piston to be extended or retracted relative to a starting point.

In one example, the work function is rotary actuation of a rotor. Thus, the operation of the motor can spin up or spin down to cause the pump to increase or decrease flow rate or pressure or both, causing a rotor to rotate differently in response to the change in hydraulic fluid.

In one example, the electronically controlled motor is a permanent magnet motor. In one example, the motor is an induction motor, although permanent magnet motors are typically more efficient and faster for power on demand than induction motors. However, proper motor design can still be effective in a valveless system.

In one example, control of the RPMs of the motor can refer to stopping the motor from spinning in response to detection of a target pressure for hydraulic fluid at the high-pressure port. In one example, control of the RPMs of the motor can refer to spinning up the motor from spinning in response to detection that a target pressure for hydraulic fluid at the high-pressure port is below a desired threshold. For spin up, spin down, or stopping the motor, the direct control of the hydraulic fluid at the high pressure port can be in place of traditional control valve operation.

In one example, the pump system is a fixed displacement pump. With the on demand pumping to directly control the hydraulic fluid, the traditional variable displacement pumps are not needed. Fixed displacement pumps deliver a fixed amount of hydraulic fluid during every operating cycle, where the cycle is dependent on the type of pump used (e.g., rotary, axial flow, piston, centrifugal, or other). Variable displacement pumps include either mechanical or electrical controller (or both in some designs) to alter the amount of fluid provided in a single cycle. Typically, the control changes the speed or rate of the cycle, which can be referred to as the rate of actuation, and the fluid displacement changes proportionally to the change in actuation time. The use of a fixed displacement pump allows for a simpler pump in the system, and the operation of the pump changes as the motor operation changes, instead of having to separately control the flow in the pump.

In one example, multiple integrated motor and pump systems are ganged together. The combining or ganging of multiple integrated motor and pump systems can be in place of multi-valve systems. For example, in a system where a large motor delivers hydraulic fluid that is controlled by selective actuation of multiple parallel valves, instead multiple integrated motor and pump systems can replace the valve. As the integrated systems already have a motor and pump, the large motor and pump can be eliminated. Multiple small, more efficient systems can be combined to replace a large system that has many inefficiencies. Thus, in place of one integrated motor and pump system with a high pressure port, there will be multiple such systems each with a separate high pressure port. The ports can be coupled to a common line to deliver to a work function, in a similar way currently done with multiple valves.

Integrated Pump System Pressure Detection

In one example, a hydraulic system includes a housing with channels for fluid flow, including a high-pressure path. The housing includes an electronically controlled motor. The system includes a high pressure port to convey fluid from the housing to a work function, where the fluid is conveyed based on operation of the motor. The system includes a pressure sensor to detect pressure of the fluid flow for the high pressure port. The system includes a controller to adjust operation of the motor based on deviation of the pressure from a reference setpoint. The reference setpoint can indicate a high pressure reference. The high pressure reference can indicate a maximum pressure desired, or a minimum pressure to trigger the need to increase the pressure.

In one example, the pressure sensor is a motor position sensor to determine a rotational speed of the motor based on rotational position and torque of the motor. The rotational position and the torque of the motor can be known from a motor controller, and the rotational speed computed from the information. The controller can be or include a motor encoder, where the encoder generates commands to position the motor. In one example, the controller computes an estimated deviation of the pressure based on the speed and torque of the motor as computed from detected rotational position and energy input into the motor.

In one example, the controller reduces the spin velocity of the motor in response to detection that the pressure has increased beyond a specified threshold. For example, the controller may spin down the motor completely. The controller may partially spin down the motor. For example, where the pressure reaches a maximum point, it can indicate an end of stroke.

In one example, the controller generates an error indication in response to detection of the pressure lower than expected for a given speed of the motor. For example, when the hydraulic system springs a leak, the pressure will be lower than expected for the given speed of the motor. The error indication can include an indication to a user or administrator of the system.

In one example, the controller is, or the controller includes, a motor encoder, in one example, the motor is a linear displacement motor. In one example, the linear displacement motor is a fixed displacement motor.

In one example, the system includes a pump. The pump is disposed in the housing to directly control the fluid flow through the channels. The pump is controlled by the motor. In one example, the pump is part of the channels, and is integrated directly into the channels in the housing surrounding the components of the motor.

Integrated System Fluid Flow Rate Control

In one example, a hydraulic system includes a housing with channels for fluid flow, which include a high-pressure path. The system includes an electronically controlled motor mounted in the housing and a high pressure port to convey fluid from the housing to a work function. The fluid is conveyed based on operation of the motor. In one example, the system does not include fluid control valves, but the fluid control is controlled directly from the motor operation. The system includes flow rate sensor to detect flow rate of the fluid for the high pressure port. The system includes a controller to adjust operation of the motor in response to detection of deviation of the flow rate from a reference setpoint. The reference setpoint can indicate a flow rate reference. The reference can indicate a maximum pressure desired, or a minimum pressure to trigger the need to increase the flow rate.

In one example, the flow rate sensor is or includes a motor position sensor to determine a rotational speed of the motor based on rotational position of the motor. In one example, the controller computes an estimated flow rate deviation. The flow rate deviation can be computed based on the speed of the motor as computed from detected rotational position.

In one example, the controller reduces the spin velocity of the motor in response to detection that the flow rate has stalled. For example, the controller may spin down the motor completely. The controller may partially spin down the motor. For example, when the flow rate stalls can be an indication of end of stroke.

In one example, the controller generates an error indication in response to detection of the pressure lower than expected for a given speed of the motor. For example, when the hydraulic system springs a leak, the flow rate will be higher than expected for the given speed of the motor. The error indication can include an indication to a user or administrator of the system.

In one example, the controller is, or the controller includes, a motor encoder. In one example, the motor is a linear displacement motor. In one example, the linear displacement motor is a fixed displacement motor.

In one example, the system includes a pump. The pump is disposed in the housing to directly control the fluid flow through the channels. The pump is controlled by the motor. In one example, the pump is part of the channels, and is integrated directly into the channels in the housing surrounding the components of the motor.

Using Post-Work Fluid for Cooling

In one example, a hydraulic system includes a housing with channels for fluid flow. The channels include a high-pressure path and a low pressure return path. The low pressure return path conveys post-work fluid. The system includes an electronically controlled motor mounted in the housing. The system includes a pump mounted in the housing and an electronic circuit to control the motor. The electronic circuit is coupled with the housing and can be integrated into the housing with the motor. The low pressure return path includes a path to convey the post-work fluid past the electronic circuit for removal of heat from the electronic circuit.

In one example, the electronic circuit is an inverter or includes inverter circuitry. In one example, the electronic circuit is or includes a motor position encoder. In one example, the hydraulic system lacks a fluid control valve between the pump and a work function to which the system pumps fluid. In one example, the low pressure return path includes a path to convey the post-work fluid past the motor.

In one example, further comprising: a fluid reservoir coupled to housing, wherein the pump is to pull the fluid from the fluid reservoir, and return the post-work fluid to the fluid reservoir. In one example, the housing includes a path from a low pressure input port to a low pressure output port to the fluid reservoir.

BRIEF DESCRIPTIONS OF THE DRAWINGS

The accompanying drawings provide certain examples that are applicable to one or more of the implementations described above. The drawings can be briefly described as follows, which provide non-limiting examples of certain features.

DETAILED DESCRIPTION

Figure 1:
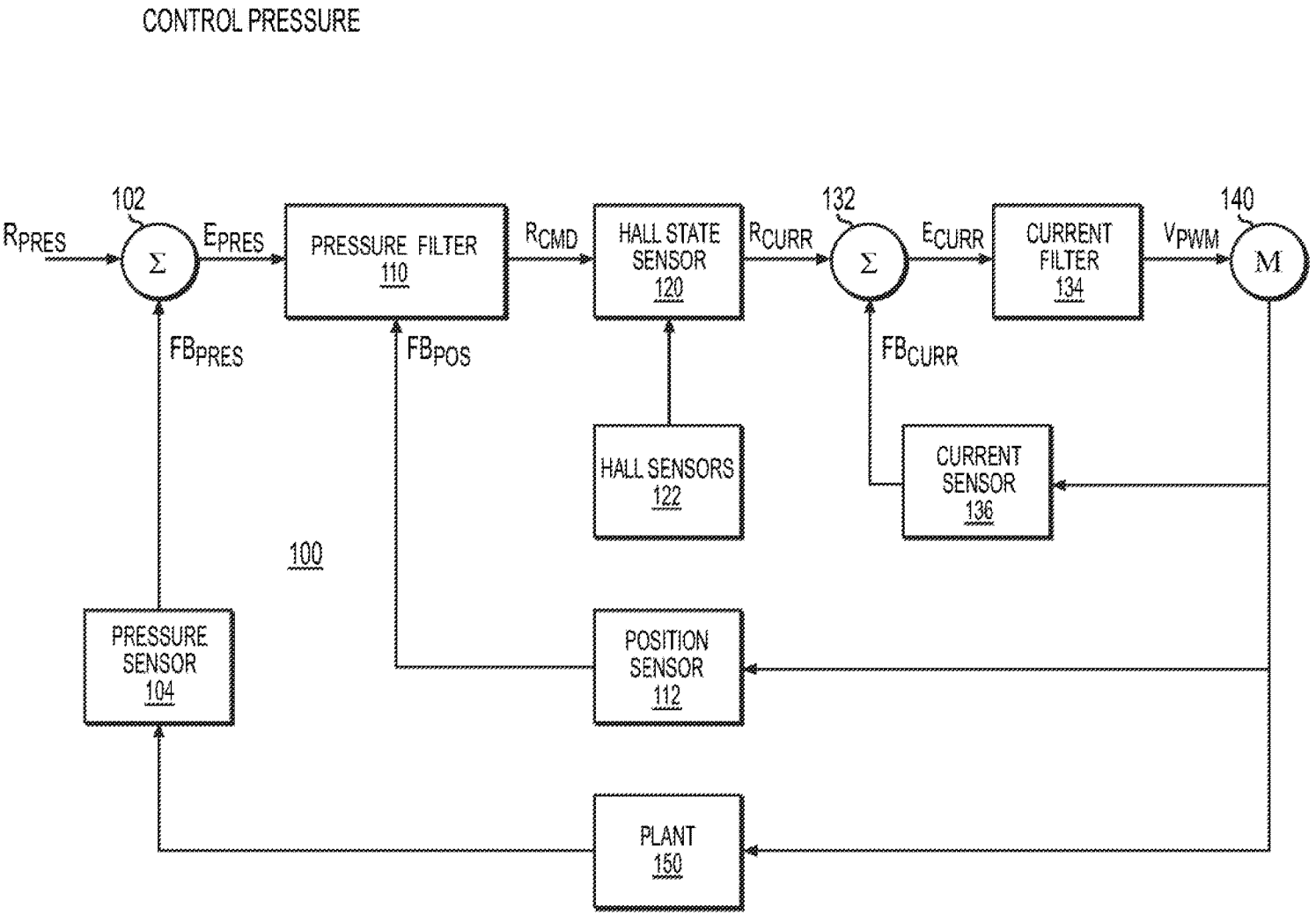
FIG. 1 depicts a control loop for monitoring and controlling pressure using the valveless hydraulic system.

FIG. 1 illustrates an example of a control loop that monitors and controls pressure in accordance with an embodiment of the invention. Pressure control system 100 provides an example of various elements that can be either hardware elements, or software control elements, or a combination of hardware elements that provide data to be used for calculation or the calculation engines. All computations are implemented in electronic components.

$R_{PRES}$ refers to a reference pressure for the specific implementation. For example, perhaps a pump system is to convey hydraulic fluid at 1000 PSI (pounds per square inch), or some other setpoint, for a specific work function. In one example, the reference pressure is configurable. An electronic controller can take the reference pressure and control operation of a motor in an integrated pump system to provide the desired pressure.

Combiner 102 represents a computational element to compare the reference pressure to a feedback pressure, $FB_{PRES}$. $E_{PRES}$ represents an error signal or difference between the reference signal and the feedback signal. The feedback signal comes from other components in the integrated pump system, as described below.

In one example, pressure filter 110 receives the error signal. Pressure filter 110 can be, or include, for example, a PID (proportional-integral-derivative) or other error compensation component. A PID device receives an error and generates an output to reduce the error. Another error compensation component can be used. In one example, pressure filter 110 generates a reference velocity signal, which indicates a motor speed that should provide the desired pressure. The correlation between motor speed and desired pressure is a metric that can be measured before implantation of the integrated pump system and stored in the memory of the controller. Then, at regular intervals, the integrated pump system can be retested or recalibrated to account for wear of the pump and or motor of the integrated pump system.

In one example, pressure filter 110 receives position feedback, $FB_{POS}$, from a motor encoder that acts as a position sensor to indicate the position of the motor. The position information typically includes a sequence of motor position and timing information to indicate where the motor was at a given time, which can be used to compute the velocity or rotational speed of the motor (e.g., RPMs or rotations per minute).

Pressure filter 110 provides a reference command, $R_{CMD}$, to a motor controller. The motor command can be with reference to a current used to drive the motor itself. Thus, pressure filter 110 can provide the reference command to a Hall effect sensor state filter. In one example, pressure filter 110 provides the reference command to an inverter (not specifically shown). In one example, pressure filter 110 provides the reference command to an amplifier (not specifically shown). The motor control circuitry uses the command to create a driving current to operate the motor 140.

Hall state sensor 120 represents a logic component to determine and perform a computation based on a Hall effect sensor information from Hall effect sensors 122. In one example, motor 140 has multiple different branches of conductors (e.g., a three-phase motor, or separately controllable groups of windings/conductor in the motor). Hall sensors 122 can indicate where current is flowing in the motor 140 to indicate what branch of the motor is currently active. With different branches of the motor 140 active at different times, currents induced in the rotor cause magnetic fields that can attract or repel magnets of the stator. The differences in magnetic fields cause the stator and rotor to move relative to each other, where typically one is fixed and the other rotates relative to the fixed component. Whether the rotor or stator is the fixed element depends on the motor design, and either design can be implemented with what is described herein.

Hall state sensor 120 can provide a reference current, $R_{CURR}$, to combiner or summer 132. Summer 132 can combine reference current with a feedback current, $FB_{CURR}$, from a current sensor of the motor. The summer 132 can generate an error current, $E_{CURR}$, to indicate a deviation of a current being used to what should be used to provide the desired pressure output.

In one example, the system includes current filter 134 to receive the current adjustment information of $E_{CURR}$. In one example, current filter 134 is or includes a PI (proportional-integral) filter or other error compensation filter component. In one example, current filter 134 generates a PWM (pulse width modulator) output, $V_{PWM}$. The PWM output can indicate a duty cycle to use to drive the motor 140 to adjust the current driving the motor. The adjusted current (and more specifically, the on/off rate of the current used to drive the motor) can cause the motor to operate differently to adjust for the given conditions to cause the desired pressure.

Motor (M) 140 represents the motor or the motor controller, which operates based on the current signal. In one example, current sensor 136 represents one or more current sensors to monitor one or more currents of the motor. The current sensors can provide the feedback current signal $FB_{CURR}$ to summer 132.

Position sensor 112 monitors a position sensor for motor 140. The position sensor 112 can determine the precise motor location and be used to determine motor velocity. In one example, position sensor 112 provides position feedback $FB_{POS}$.

Plant 150 represents a gear the motor drives. Plant 150 represents a gear within the integrated pump system driven by the motor 140 to cause the pump to pump the hydraulic fluid. Pressure sensor 104 represents one or more sensor components of the integrated system to provide pressure feedback to combiner 102.

In one example, the system computes pressure sensor state information without needing discrete pressure sensor hardware. This can be accomplished by monitoring the current going into the motor and knowing the specific geometry of the pump that would relate the input torque and output pressure (i.e., mapping the pump). These quantities can be related by the formula Pressure output=(Torque× constant)/Displacement.

Figure 2:
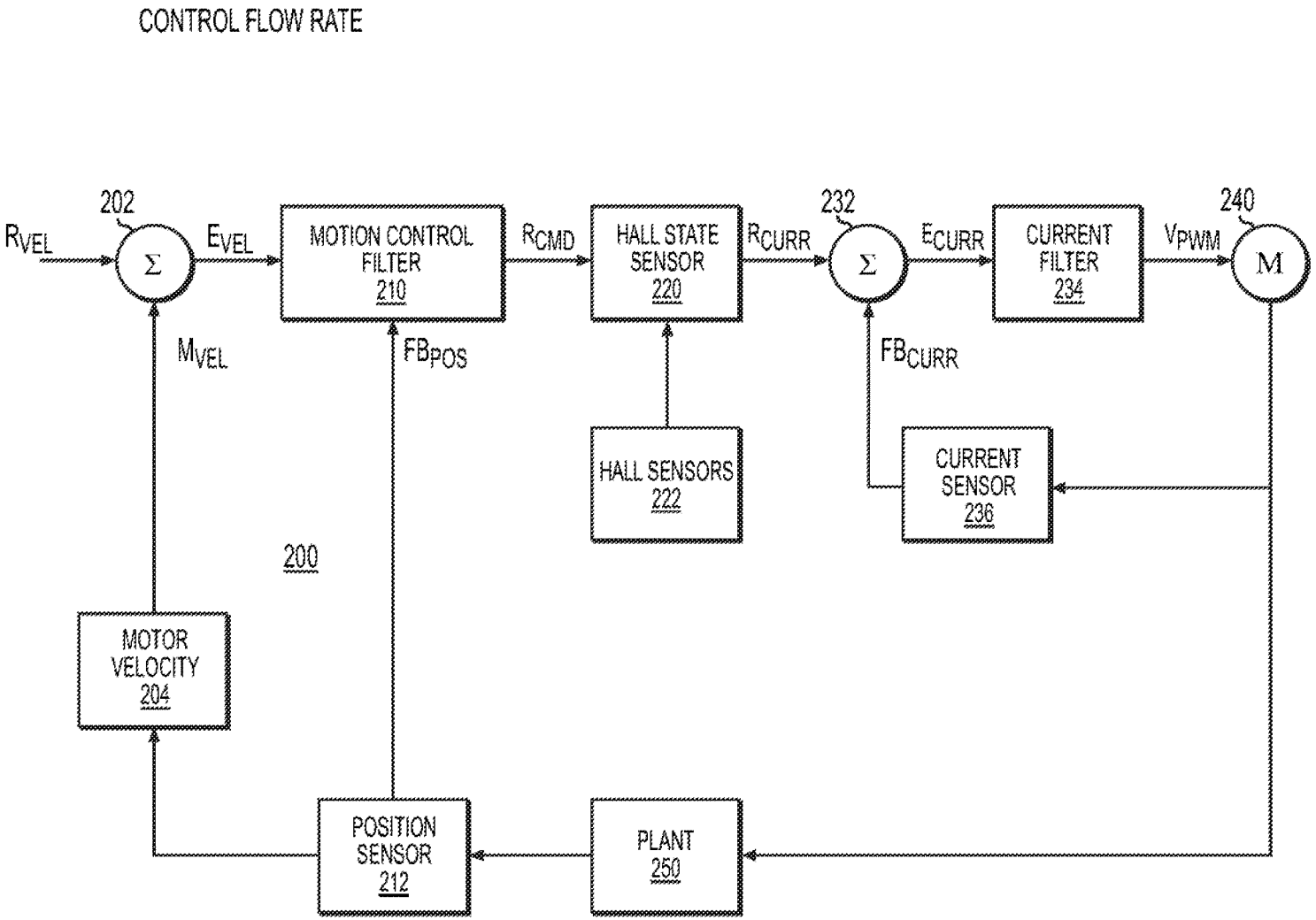
FIG. 2 depicts a control loop for monitoring and controlling flow rate using the valveless hydraulic system.

FIG. 2 illustrates an example of a flow rate control loop 200 that control flow rate, whereas pressure control system 100 of FIG. 1 controls pressure. There are many similarities between system 100 and system 200, and many components operate the same.

Flow rate control system 200 provides an example of various elements that can be either hardware elements, or software control elements, or a combination of hardware elements that provide data to be used for calculation or the calculation engines. All computations are implemented in electronic components.

$R_{VEL}$ refers to a reference velocity for the motor 240 to operate for the specific implementation of the integrated pump system. When the motor directly drives the pump to provide the fluid to the work function, the velocity of the motor 240 can act as a proxy for the flow rate of the hydraulic fluid (i.e., the correlation is known in advance by the controller of motor 240). Thus, for example, perhaps a pump system is to convey hydraulic fluid having a specific setpoint for a specific work function. In one example, the reference velocity is configurable to set different target flow rates. An electronic controller can take the reference velocity and control operation of a motor in an integrated pump system to provide the desired flow rate.

Combiner or summer 202 represents a computational element to compare the reference velocity to a feedback velocity, $M_{VEL}$, which is the velocity of the motor 240. $E_{VEL}$ represents an error signal or difference between the reference signal and the feedback signal. The feedback signal comes from other components in the integrated pump system, as described below.

Motion control filter 210 provides an example of motion control for an integrated motor 240. The motion control filter 210 includes hardware components to control the operation of the motor 240. Motion control filter 210 represents control of the hardware components to achieve the desired motor operation. In one example, motion control filter 210 receives position feedback, $FB_{POS}$, from motor position sensor 212 that monitors the position of the motor 240. In one example, the motor position sensor 212 is a sensor separate from the motor encoder. The position information typically includes a sequence of motor position and timing information to indicate where the motor 240 was at a given time, which can be used to compute the velocity or rotational speed of the motor (e.g., RPMs or rotations per minute).

Motion control filter 210 provides a reference command, $R_{CMD}$, to a motor controller. The motor command can be with reference to a current used to drive the motor itself. Thus, motion control filter 210 can provide the reference command to a Hall effect sensor 220. In one example, motion control filter 210 provides the reference command to an inverter (not specifically shown). In one example, motion control filter 210 provides the reference command to an amplifier (not specifically shown). The motor control circuitry uses the command to create a driving current to operate the motor 240.

Hall state sensor 220 represents a logic component to determine and perform a computation based on a Hall effect sensor information from Hall effect sensors 222. In one example, motor 240 has multiple different branches of conductors (e.g., a three-phase motor, or separately controllable groups of windings/conductor in the motor). Hall sensors 222 can indicate where current is flowing in the motor 240 to indicate what branch of the motor 240 is currently active. With different branches of the motor 240 active at different times, currents induced in the rotor cause magnetic fields that can attract or repel magnets of the stator. The differences in magnetic fields cause the stator and rotor to move relative to each other, where typically one is fixed and the other rotates relative to the fixed component. Whether the rotor or stator is the fixed element depends on the motor design, and either design can be implemented with what is described herein.

Hall state sensor 220 can provide a reference current, $R_{CURR}$, to summer 232. Summer 232 can combine reference current, $R_{CURR}$, with a feedback current, $FB_{CURR}$, from current sensor 236 of the motor 240. Summer 232 can generate an error current, $E_{CURR}$, to indicate a deviation of a current being used to what should be used to provide the desired pressure output.

In one example, flow rate control loop 200 includes current filter 234 to receive the current adjustment information of $E_{CURR}$. In one example, current filter 234 is or includes a PI (proportional-integral) filter or other error compensation filter component. In one example, current filter 234 generates a PWM (pulse width modulator) output, $V_{PWM}$. The PWM output can indicate a duty cycle to use to drive the motor 240 to adjust the current driving the motor. The adjusted current (and more specifically, the on/off rate of the current used to drive the motor) can cause the motor 240 to operate differently to adjust for the given conditions to cause the desired pressure.

Motor (M) 240 represents the motor or the motor controller, which operates based on the current signal $V_{PWM}$. In one example, current sensor 236 represents one or more current sensors to monitor one or more currents of the motor 240. The current sensors 236 can provide the feedback current signal $FB_{CURR}$.

Position sensor 212 represents a position sensor for motor 240. The encoder can determine the precise motor location and be used to determine motor velocity. In one example, position sensor 212 provides position feedback. Based on the position feedback, the controller can compute the rotational velocity of the motor 240.

Plant 250 represents a gear the motor drives. Plant 250 represents a gear within the integrated pump system driven by the motor 240 to cause the pump to pump the hydraulic fluid. Motor velocity 204 represents a present velocity of the motor, $M_{VEL}$, which is a state of the motor to provide to combiner 202.

Figure 3:
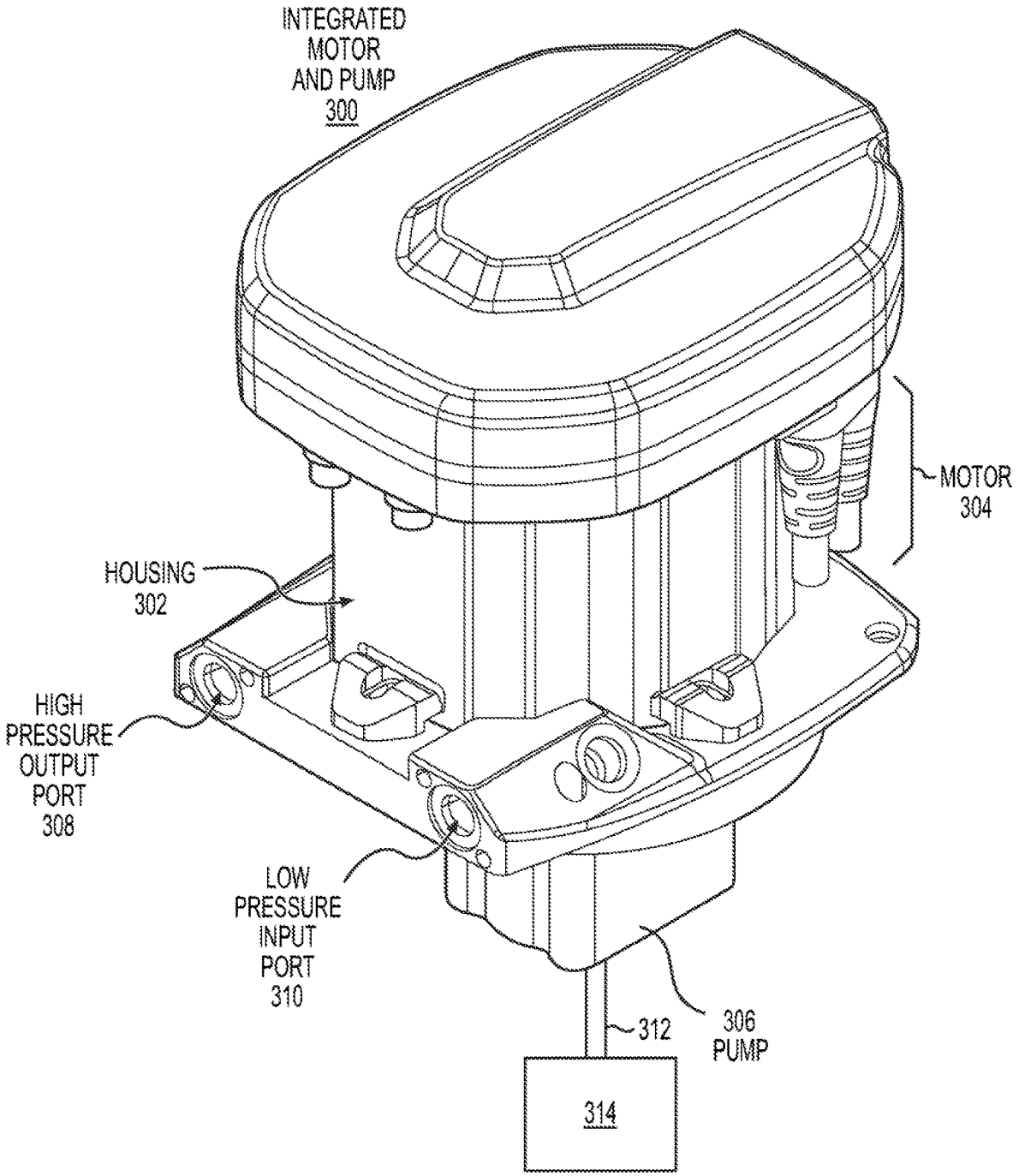
FIG. 3 depicts an exterior view of the integrated motor and pump for use with the valveless hydraulic system.

FIG. 3 represents an example of an integrated pump system 300. It will be understood that the shape and configuration of the integrated pump system 300 can be different than shown. The illustration is a non-limiting example, and one skilled in the art will understand that the possible configurations are too numerous to illustrate.

The integrated motor and pump can be referred to as an integrated pump system. Integrated pump system 300 can replace a traditional pump and the motor to drive the pump. In one example, integrated pump system 300 can directly control the hydraulic fluid output based on operation of the motor 304, eliminating the need for a flow control valve. In one example, an integrated pump system 300 can be a replacement for a valve, while also replacing the motor and pump that would traditionally provide the fluid that the valve controls.

In one example, integrated pump system 300 includes a housing 302 that includes the pump 306 and the motor 304. In one example, the housing 302 includes one or more components that have fluid channels within the housing itself, to convey fluid from the pump 306 to the high pressure output port 308. The high pressure output port 308 allows system 300 to provide work fluid to a work function.

In one example, integrated pump system 300 includes a low pressure input port 310 as a return path for the work fluid from the work function. The low pressure input port 310 receives post-work fluid. In one example, the low pressure input port 310 couples to a low pressure path inside the housing that conveys the post-work fluid past either the motor, or past the electronics, or past both the motor and the electronics. In such an implementation, integrated pump system 300 can enable use of the post-work fluid for cooling integrated pump system 300. The integrated pump system 300 can also include a input/output port 312 for coupling the integrated pump system 300 to a hydraulic fluid reservoir 314. The hydraulic fluid reservoir 314 can receive the post-work fluid and provide a path back to where the integrated pump system 300 pumps the hydraulic fluid from the hydraulic fluid reservoir 314.

Figure 4:
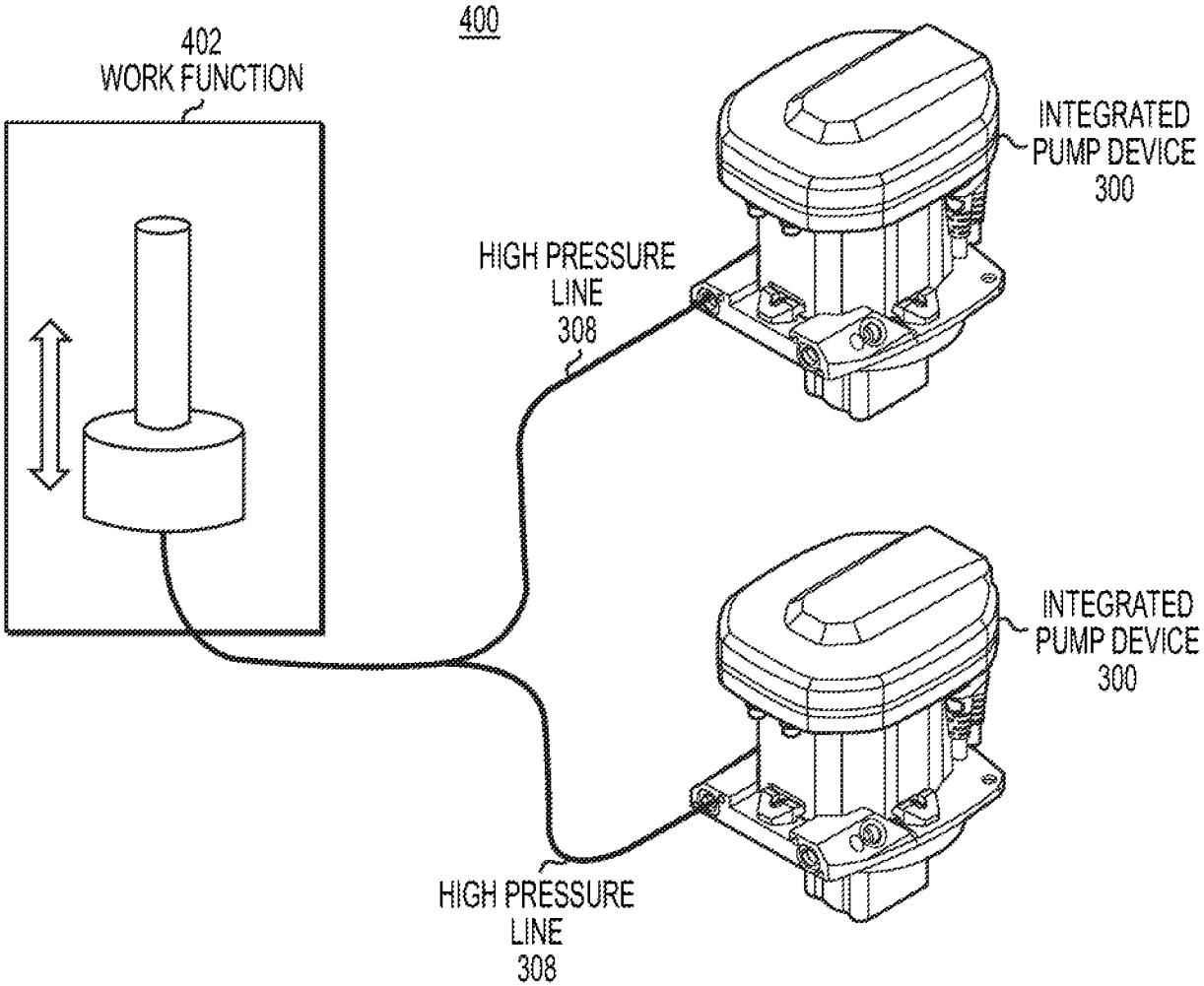
FIG. 4 depicts an example of the valveless hydraulic systems connected in parallel.

FIG. 4 represents an example of two integrated pump systems 300 coupled in a cooperating system 400. When the integrated pump system 300 is used as a replacement for a valve (e.g., a valveless hydraulic system), multiple integrated pump systems 300 can be used in parallel to provide hydraulic fluid to a common work function 402, similar to how multiple valves would couple to a command work function. It should be obvious to one of ordinary skill in the art that up to N integrated pump systems 300 can be joined together in parallel depending upon the hydraulic requirements of the work function(s) 402.

The work function 402 can be either a linear work function as illustrated (the arrow indicates the linear displacement), or can be a rotary actuator. In one example, cooperating system 400 combines the output of high pressure lines 308 of multiple integrated pump systems 300 to drive the work function 402.

Figure 5:
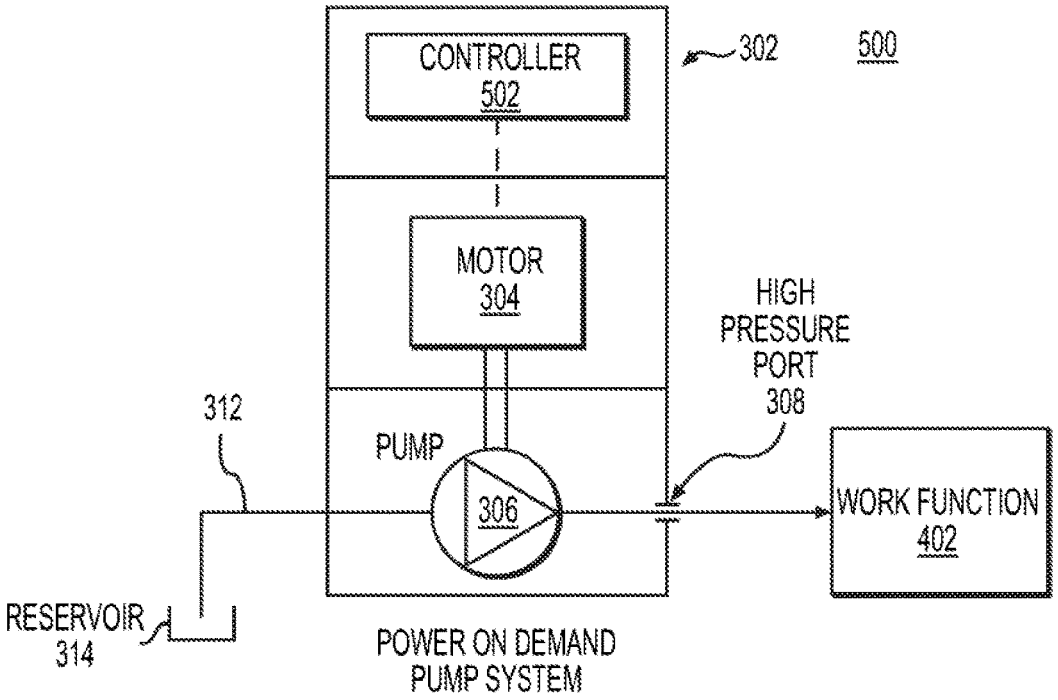
FIG. 5 depicts an embodiment of the valveless hydraulic system for providing power on demand to a work function.

FIG. 5 depicts a schematic diagram an integrated pump system 500 that accesses hydraulic fluid from a hydraulic fluid reservoir 314 and provides high pressure fluid to a work function 402 via high pressure port 308. Integrated pump system 500 functions as a power-on-demand pump system, which includes an integrated motor 304 and pump 306 in one housing 302. In the illustrated embodiment, the housing 302 also includes a controller 502 for driving the motor 304 and for monitoring the operation of the integrated pump system 500. For example, controller 502 may function as the electronics receives the various outputs of the sensors of pressure control system 100 or flow rate control system 200 and determines $V_{PWM}$ for driving the motor 304.

The motor 304 is an electric motor and controller 502 represents the control circuitry or electronics that control the operation of the motor 304. The motor 304 drives the operation of the pump 306. Based on how the motor drives the pump 306, the pump 306 directly outputs the hydraulic fluid from the high pressure port 308 to the work function 402. Thus, control over the output of the high pressure port depends 308 on the operation of the motor 304, controlling the operation of the pump 306. The hydraulic fluid reservoir 314 represents a holding container or other source of the hydraulic fluid.

Figure 6:
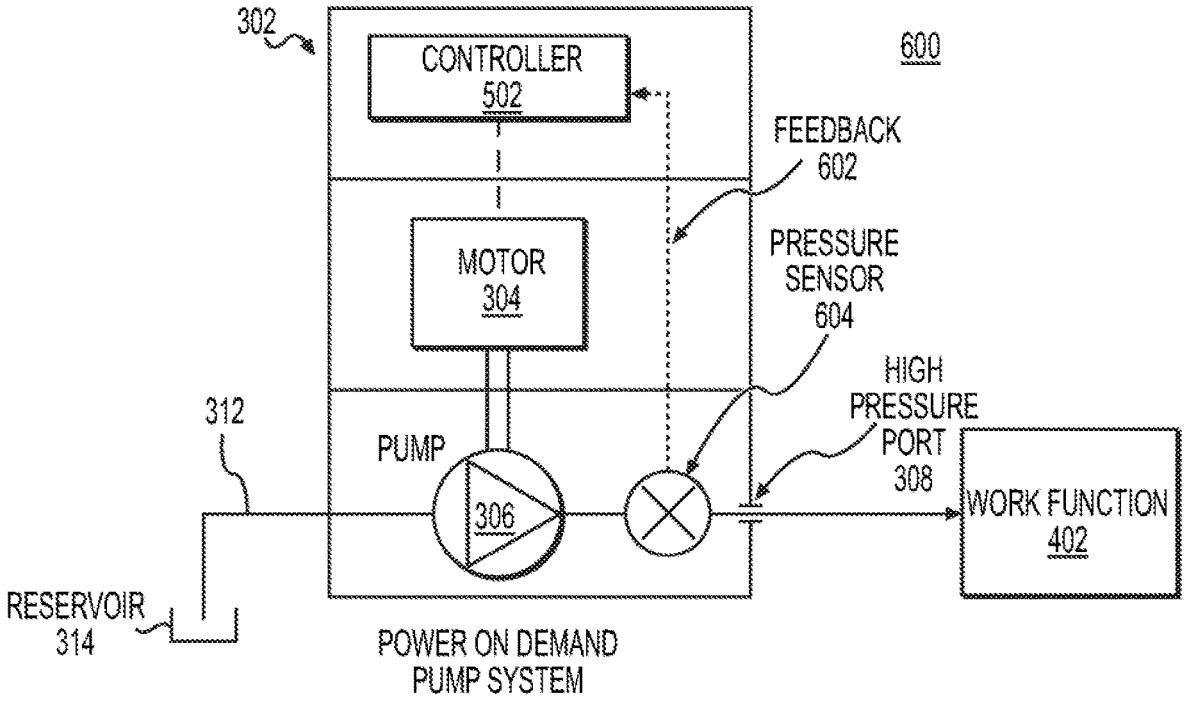
FIG. 6 depicts an embodiment of the valveless hydraulic system incorporating a controller for the motor.

FIG. 6 depicts a schematic diagram of integrated pump system 600 that accesses hydraulic fluid from a hydraulic fluid reservoir 314 and includes feedback 602 from a pressure sensor 604 which measures the pressure of the hydraulic fluid leaving high pressure output port 308. Integrated pump system 600 is a power-on-demand pump system, which includes an integrated motor 304 and pump 306 in one housing 302. In one example, as illustrated, the housing 302 also includes controller 502 for the motor 304. In one example, the housing 302 includes pressure sensor 604 to provide pressure feedback to the controller 502. For example, integrated pump system 600 may be used to implement the pressure control system 100 depicted and described with respect to FIG. 1.

The motor 304 is an electric motor and controller 502 is the control circuitry or electronics that control the operation of the motor 304. The motor 304 drives the operation of the pump 306. Based on how the motor 304 drives the pump 306, the pump 306 will directly output the fluid from the high pressure port 308 to the work function 402. Thus, control over the output of the high pressure port 308 depends on the operation of the motor 304, controlling the operation of the pump 302. The hydraulic fluid reservoir 314 is a holding container or other source of the hydraulic fluid.

In one example, the pressure sensor 604 provides feedback 602 ($FB_{PRES}$ of FIG. 1) to the controller 502. The pressure sensor 604 may be any type of pressure sensor 604. Examples of pressure sensors 604 can include discrete sensor components or can include electronics and mechanical components within the pump to provide pressure feedback. The pressure sensor 604 can provide feedback about the pressure of hydraulic fluid exiting high pressure port 308. In one example, when the detected pressure is above a threshold pressure, the controller 502 can slow the operation of the motor 304 to reduce the operation of the pump. In one example, when the pressure is lower than a threshold pressure, the controller 502 can increase the operation of the motor 304 to increase the operation of the pump 306. In this manner, constant pressure output of hydraulic through high pressure output port 308 can be maintained within a selected tolerance (i.e., between an upper pressure threshold and a lower pressure threshold).

Figure 7:
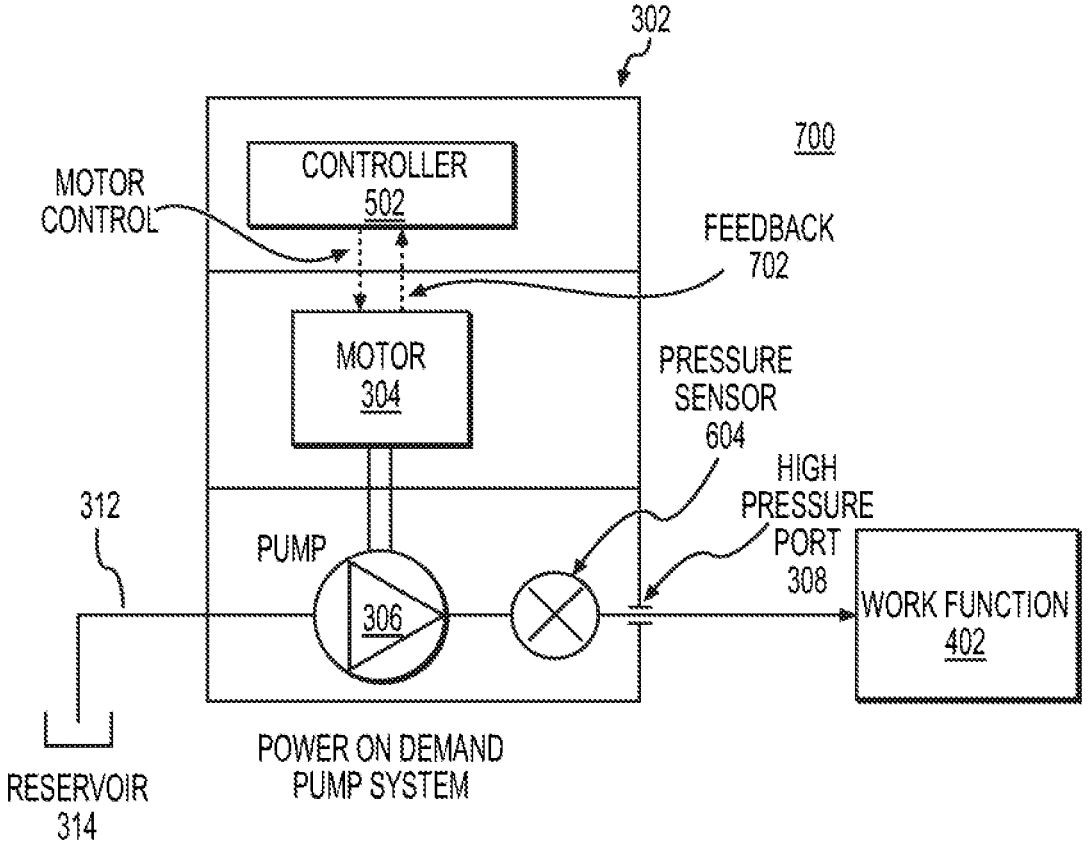
FIG. 7 depicts an embodiment of the valveless hydraulic system that includes a pressure sensor.

FIG. 7 represents an example of an integrated pump system 700 that accesses hydraulic fluid from hydraulic fluid reservoir 314 reservoir and receives motor feedback 702 directly from motor 304. Integrated pump system 700 is a power-on-demand pump system, which includes an integrated motor 304 and pump 306 in one housing 302. In one example, as illustrated, the housing 302 also includes controller 502 for the motor 304. In one example, the housing 302 includes a pressure sensor 604 to monitor a pressure of the fluid from the pump 706 to the high pressure port 308.

The motor 304 is an electric motor and controller 502 provides the control circuitry or electronics that control the operation of the motor 304. The motor 304 drives the operation of the pump 306. Based on how the motor 304 drives the pump 306, the pump 306 directly outputs hydraulic fluid from the high pressure port 308 to the work function 402. Thus, control over the output of the high pressure port 308 depends on the operation of the motor 304, controlling the operation of the pump 306. The hydraulic fluid reservoir 314 is a holding container or other source of the hydraulic fluid.

In one example, the pressure sensor 604 represents sensor hardware that may be integrated into the pump 306, motor 304, or both. The pressure sensor 604 can thus provide feedback to the controller 502 via a connection of the motor 304 with the controller 502. The controller 502 provides motor control to the motor 304, and the motor 304 can provide motor feedback 702, such as motor position and speed of the motor, to the controller 502. In one example, the controller 502 computes pressure information based on the motor feedback 702 through the motor 304. In one example, when the detected pressure is above a threshold pressure, the controller 502 can slow the operation of the motor 304 to reduce the operation of the pump. In one example, when the pressure is lower than a threshold pressure, the controller 502 can increase the operation of the motor 304 to increase the operation of the pump 306.

Figure 8:
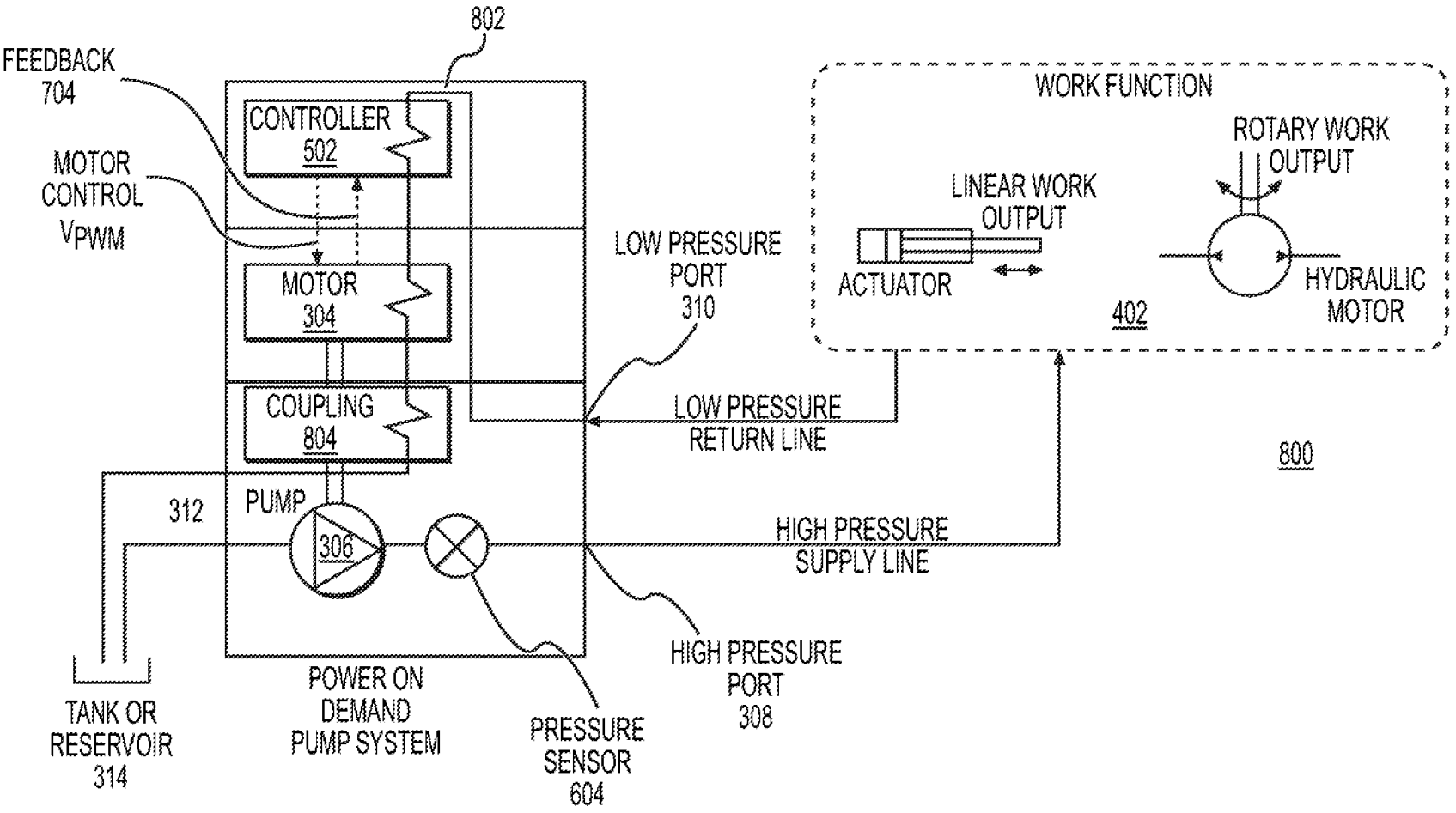
FIG. 8 depicts an embodiment of the valveless hydraulic system that includes feedback of the hydraulic fluid for cooling.

FIG. 8 represents an example of an integrated pump system that accesses fluid from a reservoir and includes feedback through the motor. System 800 includes a power on demand pump system, which includes an integrated motor and pump in one housing. In one example, as illustrated, the housing also includes a controller for the motor. In one example, the housing includes a pressure sensor to monitor a pressure of the fluid from the pump to the high pressure port. In one example, the system provides a low pressure fluid return path to cool the electronics and motor.

The motor represents an electric motor and controller represents the control circuitry or electronics that control the operation of the motor. The motor drives the operation of the pump. Based on how the motor drives the pump, the pump will directly output the fluid from the high pressure port to the work function. Thus, control over the output of the high pressure port depends on the operation of the motor, controlling the operation of the pump. The reservoir represents a holding container or other source of the hydraulic fluid.

In one example, the pressure sensor represents sensor hardware that can be integrated into the pump or motor or both. The pressure sensor can thus provide feedback to the controller via a connection of the motor with the controller. The controller provides motor control to the motor, and the motor can provide feedback, such as motor position and speed of the motor, to the controller. In one example, the controller computes pressure information based on the feedback through the motor. In one example, when the pressure is above a threshold pressure, the controller can slow the operation of the motor to reduce the operation of the pump. In one example, when the pressure is lower than a threshold pressure, the controller can increase the operation of the motor to increase the operation of the pump.

Typically, after the work is performed in a hydraulic system, the hydraulic fluid is returned to the hydraulic fluid reservoir. This returned hydraulic fluid is at a lower than the supply line due to the work being performed at the work function. In an embodiment of the invention, the returned hydraulic fluid is used to cool controller 502, motor 304, and the shaft coupling 804 before the hydraulic fluid is return to hydraulic reservoir 314. A schematic diagram showing this feature is depicted in FIG. 8 using integrated pump system 800.

The hydraulic fluid exits through high pressure port 308 and is used to perform linear work or rotary work at work function 402. This causes the hydraulic fluid to decrease in pressure. The low pressure hydraulic fluid is generally at a maximum temperature of 140-160° F. This temperature is still much cooler than the temperature that the electronics of controller 502 operate or the temperature at which motor 304 and/or the shaft coupler operates.

The low pressure hydraulic fluid enters integrated pump system 800 via low pressure return line 310. The hydraulic fluid is guided through a cooling fluid channel 802 passing through/over the electronics of controller 502 and motor 304 as depicted, after which it returns to hydraulic fluid reservoir 314. The controller 502 preferable comprises a heat sink coupled to the electronics. The cooling fluid channel 802 preferably passes through or over the heat sink to provide effective cooling as is known in the fluid cooling arts. For example, cooling fluid channel 802 preferably comprises a section which coils around motor 304 to increase the surface area engagement and to spread the heat transfer over the surface equally.

Optionally, or in addition, the low pressure hydraulic fluid (oil) may be passed directly over the shaft coupling 804 to provide lubrication in a continuous oil bath. The mating of the motor shaft and the pump shaft may either be direct or through the use of a coupling to connect the two shafts. The coupling of the cooling fluid channel 802 to the shaft coupling 804 is preferably sealed with o-rings or gaskets to prevent any leakage of the hydraulic fluid. Baffles may also be employed to create a slight back pressure to force the hydraulic fluid through shaft coupling 804.

The hydraulic fluid that is moved by pump 306 is forced into the area that the motor shaft and pump shaft mate after it is used to cool the motor 304 and controller 802 as depicted in FIG. 8. The hydraulic fluid thus provides both lubrication and cooling to the motor 304 and pump 306. This guarantees that the motor and pump shafts are continuously lubricated with oil any time the motor 304 is spinning. Using the hydraulic oil for cooling and lubrication also allows for the elimination of a dedicated cooling system that may normally be present on a piece of hydraulic equipment.

When integrated pump system 800 is operating in a standard pump mode and providing uni-directional flow to a valve bank like any traditional electronic system, the heat generated by integrated pump system 800 can be reduced by over 50%. However, if integrated pump system 800 is utilized as depicted in FIG. 8 and directly provides/return hydraulic fluid from work function 402, the heat generated can be reduced by over 80% when compared with a traditional HPU with direction, pressure, and control valves. This leads to an overall efficiency of 50-80% when compared with other hydraulic systems (e.g., servo driven HPU, induction motor driven, or combustion engine driven).

Figure 9:
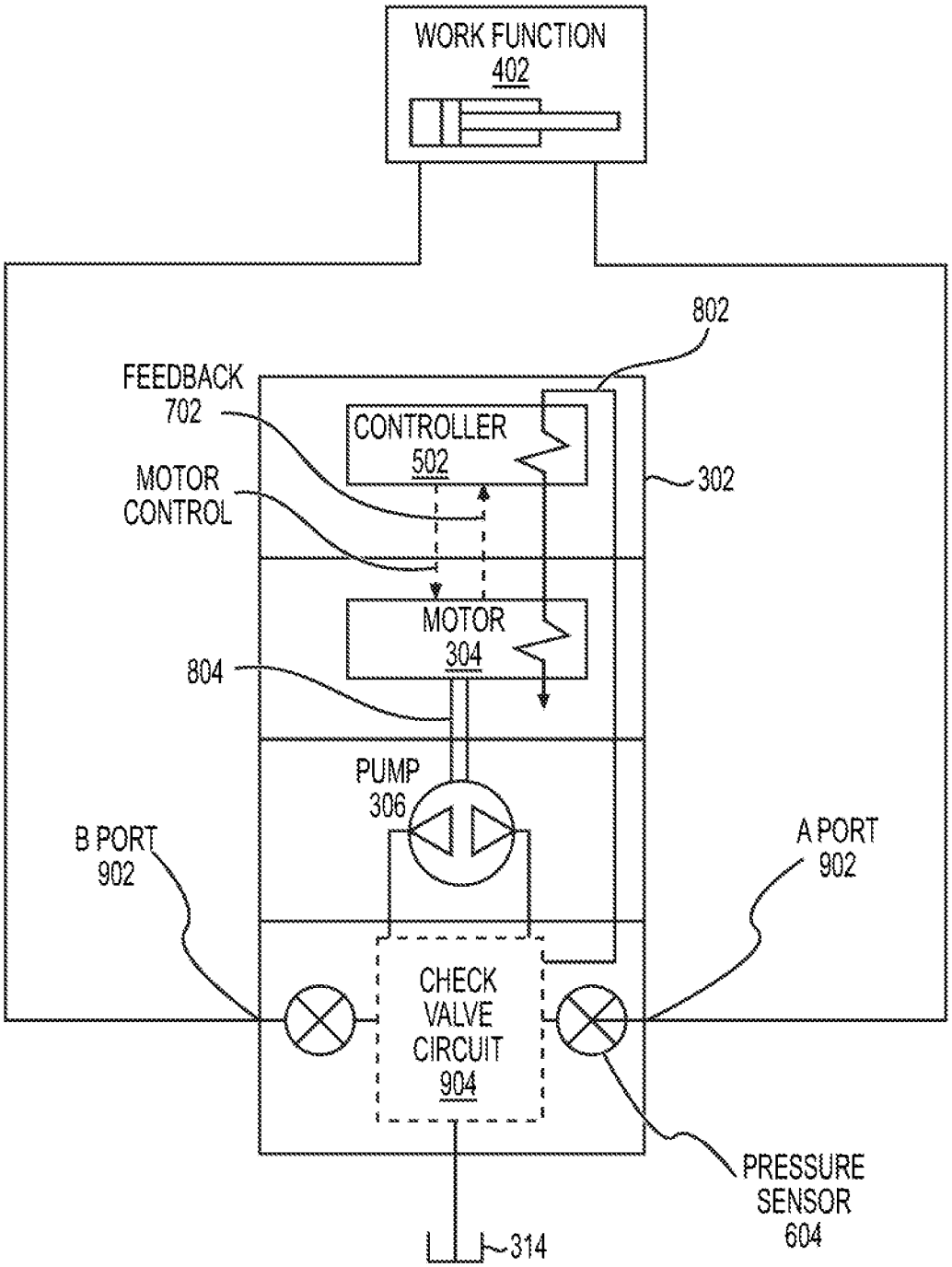
FIG. 9 depicts an embodiment of the valveless hydraulic system capable of bi-directional pumping.

FIG. 9 depicts an embodiment of integrated pump system 900 capable of bi-directional pumping the hydraulic fluid. In this embodiment, motor 304 is preferably a permanent magnet motor. This type of motor has the advantage that it is highly efficient, can be revved up quickly, and is reversible. High pressure output port 308 and low output pressure port 310 are replaced by bi-directional ports 902 which are each configured to output high pressure hydraulic fluid to work function 402 depending upon the direction of the operation of motor 304.

The output of the pump is routed through a check valve 904 which can be switched such that the high pressure hydraulic fluid is routed from reservoir 314 through either port, depending upon the current pumping direction. Another output of the check valve 904 is coupled to cooling fluid channel 802 to ensure that the low pressure hydraulic fluid always flows in the same direction, namely, first past controller 502, past motor 304, and then through shaft coupling 804 to provide lubrication as already described. Through use of the check valve 904, bi-directional flow of the hydraulic fluid is achieved without requiring the motor 304 to reverse direction.

As previously described, the integrated pump systems depicted in FIGS. 1-9 incorporated a plurality of sensors (motor velocity sensor, motor position sensor, current sensor, Hall state sensors, etc.). The motor 304 is initially calibrated so that a known motor velocity produces a known pressure or flow output. However, as the motor 304 and pump 306 degrade over time, the same motor velocity will naturally create a lower pressure or flow output. In some embodiments of the present invention, controller 502 includes an auto calibration in which the motor 304 is run at a plurality of different speeds and the resulting flow or output pressure is recorded. This allows controller 502 to create a new output model for the integrated pump system which can then be used to update the control algorithms utilized by controller 502 in controlling motor 304.

Controller 502 is able to accurately control the torque and RPM of motor 304 in order to drive pump 306. If pump 306 is a fixed displacement pump, the output pressure and flow depend on the input torque and RPM of motor 304. The exact relationship between the inputs, torque and rpm, and the outputs, pressure and flow, depend on a combination of both the geometry of the pump 306 and the various inefficiencies that hinder the pumping action such as friction and leakage.

By using the integrated pressure sensors and flow sensors in the device in integrated pump system 100 or integrated pump system 200, the pressure and flow rate produced by driving the pump with a known torque and RPM can be measured. These measurements can then be used to accurately predict the output pressure and flow rate of the pump 306 if it is driven with a similar known torque and RPM.

As the pump 306 wears over time, the relationship between input torque and speed relative to the output pressure and flow will change and become less efficient. As the pump 306 becomes less efficient, it will require higher torques and speeds to produce the same pressure and flow output. The auto calibration described above can function as a diagnostic routine that could be run either automatically or by request from a user to assess the state of the pump 306. This information is used to effectively choose a target torque or RPM to reach a commanded pressure or flow rate. For example, the motor 304 may have initially spun at 2000 rpm to achieve a target flow rate of 10 gpm, but over time the pump 306 has worn so that 2000 rpm achieves only 9.8 gpm. After calibration, the device would be able to determine that a target of 10 gpm should be obtained by driving the pump 306 at perhaps 2200 rpm.

After performing a significant number of diagnostics on a wide sample of pumps 306, it is possible to preemptively predict when a pump 306 is going to wear to the point that it no longer satisfies the requirements of the given work function 402. This information could be used to notify the user to replace the pump 306 at a non-critical work time. This greatly increases the chance that a pump 306 does not fail catastrophically while performing a critical function, generally increasing the "up time" of the integrated pump system.

Figure 10:
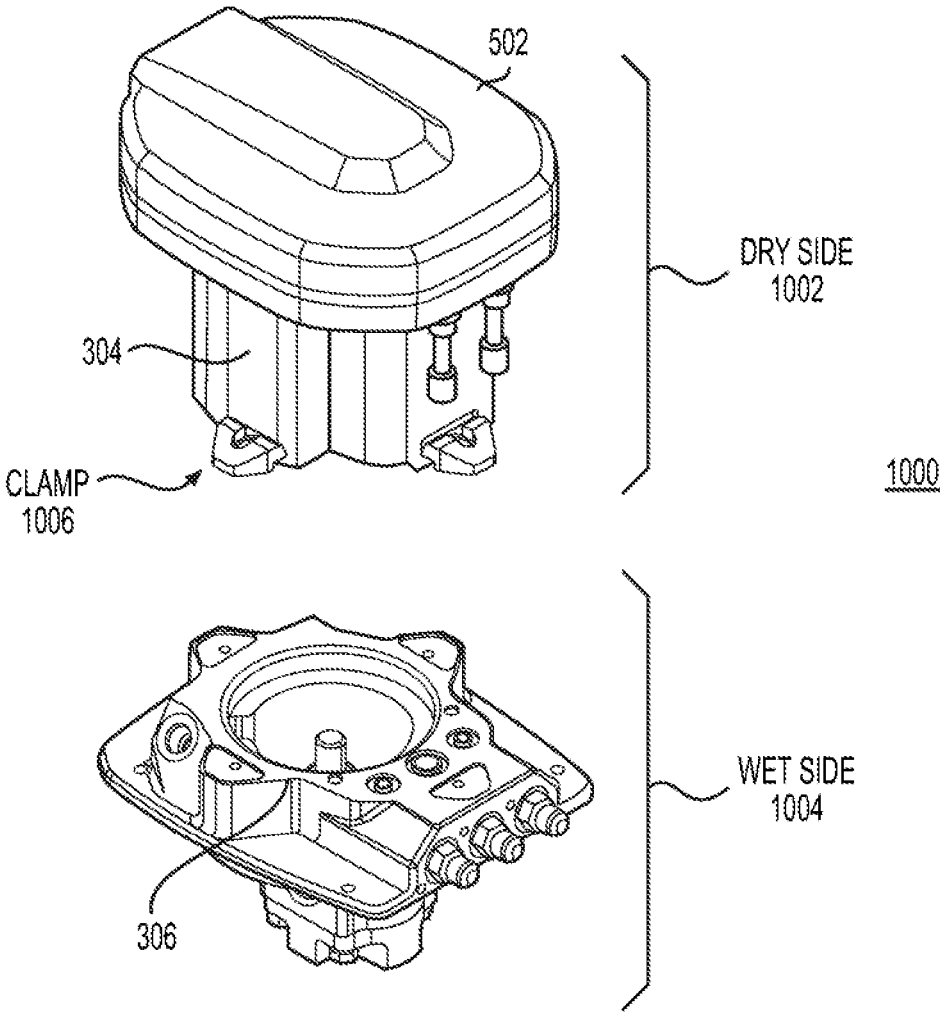
FIG. 10 depicts a modular version of the integrated pump system.

As previously explained, the integrated pump systems of FIGS. 1-9 utilize a single housing 302 in which a motor 304 and pump 306 are co-located. However, in some embodiments, the motor 304 and pump 306 may be manufactured as separate "wet" and "dry" units which can be coupled together in a modular fashion. For example, FIG. 10 depicts a modular integrated pump system 1000 comprising dry side 1002 and wet side 1004. Dry side 1002 incorporates the elements of modular integrated pump system 1000 where electronic connections are made, including the connection between motor 304 and controller 502. Wet side 1004 incorporates pump 306 and all the hydraulic hose connections, such as high pressure output port 308 and low pressure output port 310. This is achieved by using a self-aligning mechanical spline shaft coupler which is mechanically affixed to the splined shaft of the motor 304. That is, the dry side 1002 comprises an external male shaft having gears which couples with a receiving spline hub on the wet side 1004. One of ordinary skill in the art would recognize that any type of spline shat coupling 804 would be compatible with the present invention for allowing motor 304 to be coupled to pump 306. A set of four retaining clamps 1006 are used to releasably couple dry side 1002 to wet side 1004.

This modularity allows dry side 1002 to easily be removed away from wet side 1004 for inspection and/or replacement. If the controller of dry side 1002 reaches end of life, a new dry side 1002 can be installed in its place without the cumbersome practice of needing to remove and cap/cover exposed hydraulic hose ends. This minimizes opportunities for oil contamination or hazardous spills.

Figure 11:
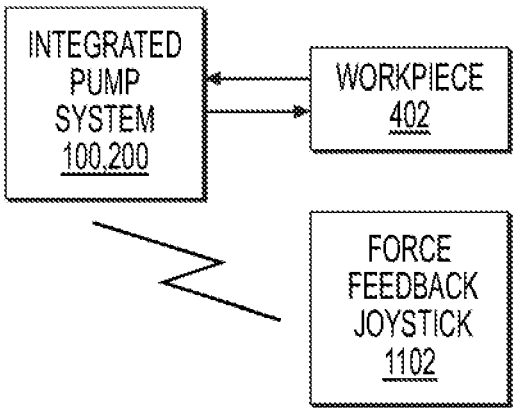
FIG. 11 depicts a force feedback joystick for use with the integrated pump system.

Referring next to FIG. 11, depicted is a schematic diagram of an integrated pump system (100, 200) incorporating a force feedback joystick 1102. The integrated pump system 100, for example, incorporates pressure sensor 104 which is used to control the output pressure of the hydraulic fluid. In this embodiment, the output of pressure sensor 104 is also broadcast over a communication network, either wired or wirelessly. The resulting pressure information is fed into force feedback joystick 1102 in real time. As the pressure output increases to work function 402, the force feedback joystick 1102 would be adjusted such that resistance to movement of the joystick is increased in accordance with the pressure amount (e.g., linearly or non-linearly). This is useful for informing the user or operator of a machine. For example, if there is a sudden obstruction at a work function, this would cause the pressure output to quickly increase. This increase would immediately be noticeable by a user attempting to use the force feedback joystick because the amount of effort required to move the joystick would suddenly be increased. A typical hydraulic power unit would not have this pressure information available digitally without the addition of a digital pressure sensor external to the power unit itself.

The invention claimed is:

1. An integrated pump system comprising:

an electronically controlled motor;

a hydraulic fluid reservoir;

a controller for controlling a speed and a torque of the motor;

a pump directly coupled to the electronically controlled motor for pumping high pressure hydraulic fluid through a first output port to a work function over a high pressure supply line; and a low pressure return line for directly returning low pressure hydraulic fluid from the work function to a cooling fluid channel interfaced with electronics of the controller and the motor, wherein the low pressure hydraulic fluid returning from the work function is conveyed through the cooling fluid channel to cool the electronics of the controller and the motor; and wherein the hydraulic fluid reservoir directly receives all low pressure hydraulic fluid from the cooling fluid channel through a return line, and wherein the pump draws hydraulic fluid from the hydraulic fluid reservoir through a supply line when pumping the high pressure hydraulic fluid through the first output port.

2. The integrated pump system according to claim 1, wherein the controller comprises:

a heat sink coupled to electronics of the controller, and wherein the cooling fluid channel comprises a serpentine section thermally coupled to the heat sink.

3. The integrated pump system according to claim 1, wherein the motor comprises a splined shaft for directly coupling to a hub of the pump.

4. The integrated pump system according to claim 3, wherein the low pressure hydraulic fluid in the cooling fluid channel is passed over the splined shaft and the hub to provide cooling and lubrication.

5. The integrated pump system according to claim 1, further comprising:

a second output port; and;

a valve coupled to the first port and the second output port, wherein switching the valve from the first output port to the second output port by the motor causes the high pressure hydraulic fluid to flow in an opposite direction to the work function.

6. The integrated pump system according to claim 1, further comprising:

a first side including the controller and the motor, and a second side including the pump, wherein the first side is releasably coupled to the second side.

7. The integrated pump system according to claim 6, wherein the first side comprises a waterproof housing for sealing the controller and the motor.

8. The integrated pump system according to claim 6, wherein the first output port is disposed on the second side.

9. The integrated pump system according to claim 6, wherein the first side includes an exterior splined shaft driven by the motor, and wherein the second side includes a hub for driving the pump, wherein the exterior splined shaft is configured to receive the hub when the first side is coupled to the second side.

10. The integrated pump system according to claim 6, wherein the first side is coupled to the second side through retaining clamps.

11. The integrated pump system according to claim 1, further comprising:

a pressure sensor for monitoring the pressure level of the high pressure hydraulic fluid at the first output port, wherein the pressure level is monitored by the controller;

a transmitter for broadcasting the pressure level to a force feedback controller, wherein a resistance level of a joystick of the force feedback controller is adjusted in proportion to the pressure level.

12. The integrated pump system according to claim 11, wherein the controller comprises a pressure output model correlating the speed and the torque of the motor to a pressure level of a high pressure hydraulic fluid, and wherein the controller utilizes the monitored pressure level to adjust the speed or torque of the motor using the pressure output model to maintain a constant output pressure or a constant flow rate at the first output port within a predetermined threshold.

13. The integrated pump system according to claim 12, wherein the controller comprises an auto calibration circuit, wherein the auto calibration circuit periodically causes the motor to operate at a plurality of different speeds and torque levels and the auto calibration records a calibration pressure output at each of the plurality of different speeds and torque levels, and wherein the auto calibration circuit updates the pressure output model using the recorded calibration pressures.

14. The integrated pump system according to claim 12, wherein the controller monitors a total output volume of the high pressure hydraulic fluid using the pressure sensor, and wherein the controller outputs a pump wear message after the total output volume exceeds a predetermined threshold.

15. The work function according to claim 1, wherein the work function is machinery operated by the hydraulic fluid.

16. The work function according to claim 1, wherein the low pressure return line returns all low pressure hydraulic fluid from the work function to the cooling fluid channel.

17. The work function according to claim 16, wherein the low pressure hydraulic fluid cools the electronics of the controller before the motor.

* * * * *